US007753448B2

(12) United States Patent
Chen et al.

(10) Patent No.: US 7,753,448 B2
(45) Date of Patent: Jul. 13, 2010

(54) SEAT POSITION-ADJUSTING DEVICE FOR A HIGHCHAIR

(75) Inventors: Shun-Min Chen, Taipei (TW); Zhi-Ren Zhong, Taipei (TW)

(73) Assignee: Wonderland Nurserygoods Co., Ltd. (TW)

( * ) Notice: Subject to any disclaimer, the term of this patent is extended or adjusted under 35 U.S.C. 154(b) by 23 days.

(21) Appl. No.: 11/566,804

(22) Filed: Dec. 5, 2006

(65) Prior Publication Data

US 2007/0194614 A1 Aug. 23, 2007

(30) Foreign Application Priority Data

Feb. 21, 2006 (CN) ..... 2006 2 0002377

(51) Int. Cl.
*A47C 1/00* (2006.01)
*A47D 1/02* (2006.01)

(52) U.S. Cl. ..... 297/344.18; 297/16.1

(58) Field of Classification Search ..... 297/148, 297/149, 150, 151, 153, 154, 337, 338, 344.12, 297/344.18, 16.1, 344.14
See application file for complete search history.

(56) References Cited

U.S. PATENT DOCUMENTS 5,348,374 A 9/1994 Kuo
5,468,051 A * 11/1995 Huang ..... 297/344.18
5,507,550 A * 4/1996 Maloney ..... 297/153
5,558,400 A 9/1996 Poulson et al.
5,951,102 A * 9/1999 Poulson et al. ..... 297/130
6,050,643 A * 4/2000 Kain et al. ..... 297/344.18
6,126,236 A * 10/2000 Wu ..... 297/325
6,161,898 A * 12/2000 Brevi ..... 297/328
6,899,394 B2 * 5/2005 Wang ..... 297/344.22
6,951,371 B2 * 10/2005 Wang ..... 297/344.14
2003/0218366 A1 * 11/2003 Rho ..... 297/153
2005/0017549 A1 * 1/2005 Chen ..... 297/16.1
2007/0024095 A1 * 2/2007 Chen ..... 297/16.1

* cited by examiner

*Primary Examiner*—Milton Nelson, Jr.
(74) *Attorney, Agent, or Firm*—Ostrolenk Faber LLP

(57) ABSTRACT

A seat position-adjusting device is used to connect adjustably a seat to a leg unit of a highchair, and includes a tube component, a slide seat and a locking unit. The tube component is sleeved on the leg unit, and is formed with positioning holes aligned along a tube axis. The slide seat is sleeved on the tube component, and is connected to the seat. The locking unit includes a latch disposed in the slide seat, pivoted to the slide seat, and pivotable between locking and unlocking positions to engage and disengage a selected positioning hole to thereby selectively lock and unlock the slide seat relative to the tube component.

10 Claims, 10 Drawing Sheets

SEAT POSITION-ADJUSTING DEVICE FOR A HIGHCHAIR

CROSS-REFERENCE TO RELATED APPLICATION

This application claims priority of Chinese Application No. 200620002377.1, filed on Feb. 21, 2006.

BACKGROUND OF THE INVENTION

1. Field of the Invention

The invention relates to a position-adjusting device, more particularly to a seat position-adjusting device for a highchair.

2. Description of the Related Art

A conventional adjustable highchair includes a chair frame, a seat, and a seat position-adjusting device for connecting adjustably the seat to the chair frame, thereby permitting adjustments to the height of the seat on the chair frame. Examples of the conventional adjustable highchair are disclosed in U.S. Pat. Nos. 5,348,374, 5,468,051, 5,558,400, and 6,161,898.

SUMMARY OF THE INVENTION

The object of the present invention is to provide a seat position-adjusting device that can be used to connect a seat to a leg unit of a highchair, that has a relatively simple construction, and that can be operated with relative ease.

According to the present invention, a seat position-adjusting device is provided for connecting adjustably a seat to a leg unit of a highchair, and comprises a tube component, a slide seat, and a locking unit.

The tube component is adapted to be sleeved on the leg unit, and is formed with a plurality of spaced apart positioning holes aligned along a tube axis.

The slide seat is sleeved on the tube component, and is adapted to be connected to the seat.

The locking unit includes a latch disposed in the slide seat, pivoted to the slide seat, and pivotable between a locking position, where the latch engages a selected one of the positioning holes in the tube component to lock the slide seat onto the tube component, and an unlocking position, where the latch is disengaged from the positioning holes in the tube component to unlock the slide seat from the tube component.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
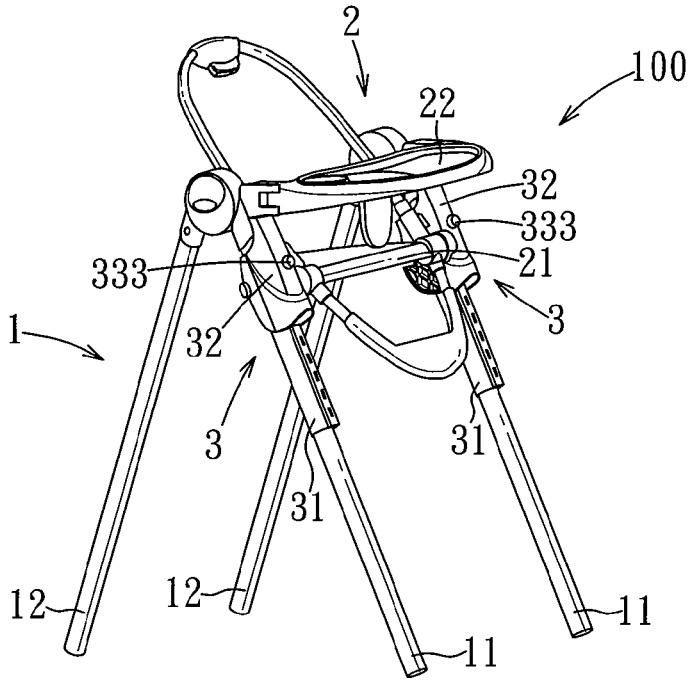
FIG. 1 is a perspective view of a highchair that incorporates the first preferred embodiment of a seat position-adjusting device according to the present invention, illustrating a seat of the highchair at a highest position.
Figure 2:
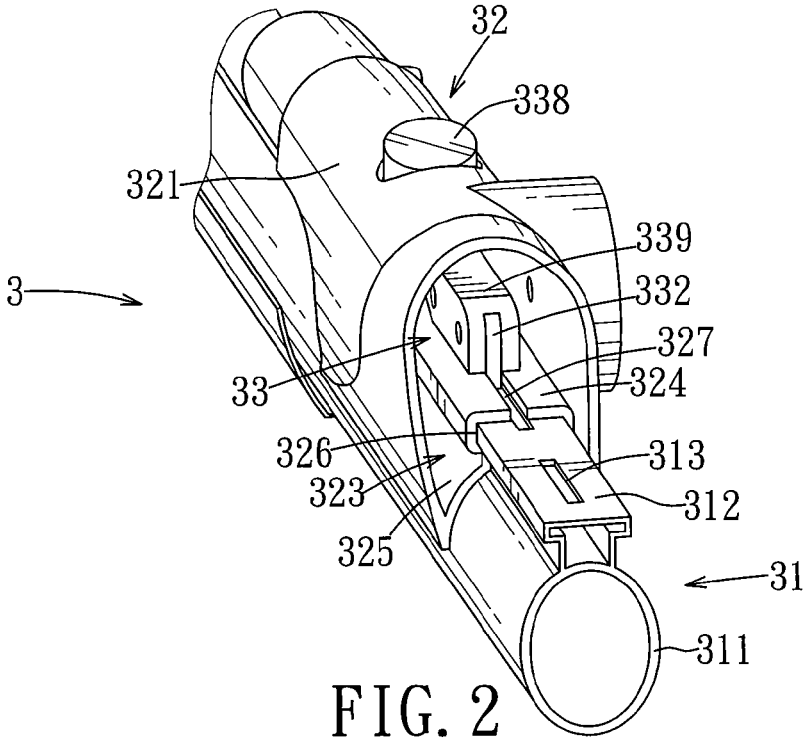
FIG. 2 is an assembled perspective view of the first preferred embodiment.
Figure 3:
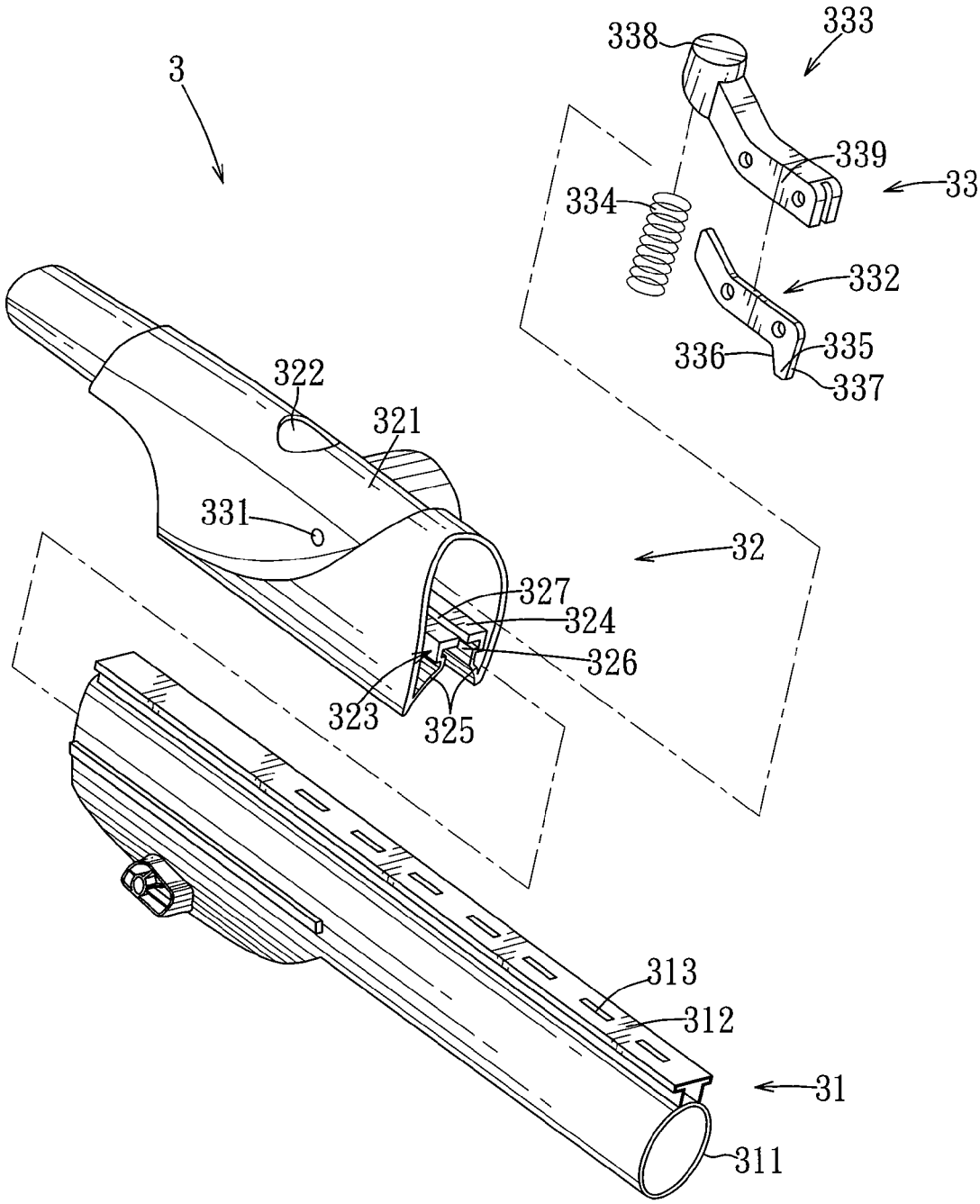
FIG. 3 is an exploded perspective view of the first preferred embodiment.
Figure 4:
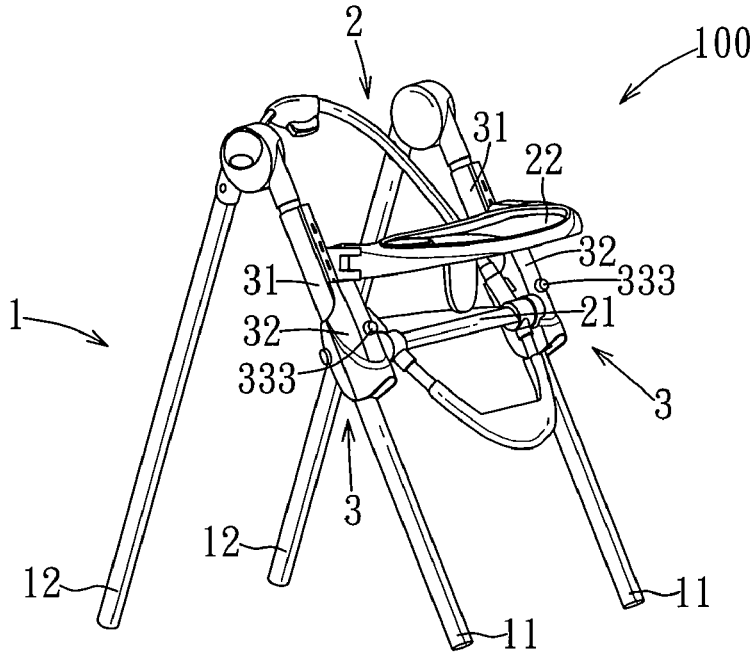
FIG. 4 is a view similar to FIG. 1, but illustrating the seat of the highchair after a downward adjustment operation.

Referring to FIGS. 1 to 3, two seat position-adjusting devices 3 according to the first preferred embodiment of the present invention are employed to connect adjustably a seat 2 to a leg unit 1 of a highchair 100. The leg unit 1 includes a pair of front legs 11, and a pair of rear legs 12 connected pivotally and respectively to upper ends of the front legs 11 in a conventional manner. The seat 2 includes a seat member 21 disposed between the front and rear legs 11, 12 and a tray 22 at a front side of the seat member 21. Each of the seat position-adjusting devices 3 connects a lateral side of the seat member 21 to a respective front leg 11, and permits height adjustment of the seat 2.

Each of the seat position-adjusting devices 3 includes a tube component 31, a slide seat 32, and a locking unit 33.

The tube component 31 is made of plastic in this embodiment, and includes a tube body 311 adapted to be sleeved on and to be fixed to an upper part of the respective front leg 11, and a guide rail 312 that projects radially outward from a front side of the tube body 311, that extends parallel to a tube axis, and that has a T-shaped cross-section along a plane transverse to the tube axis. The guide rail 312 has a flat wall formed with a plurality of spaced apart rectangular positioning holes 313 aligned along the tube axis.

The slide seat 32 is also made of plastic in this embodiment, is sleeved on the tube component 31, and is adapted to be connected to the seat member 21. The slide seat 32 includes a hollow seat body 321 that accommodates the locking unit 33 therein. The seat body 321 has a front side formed with a circular through hole 322, and a rear side formed with a wall part 323. The wall part 323 includes a hollow T-shaped portion 324 and a pair of curved portions 325 that extend from the T-shaped portion 324. The T-shaped portion 324 confines a rail groove 326, the shape of which corresponds to the cross-section of the guide rail 312. The curved portions 325 are shaped to complement the outer contour of the tube body 311 of the tube component 31 such that, when the guide rail 312 is received slidably in the rail groove 326, the curved portions 325 contact slidably the tube body 311. The T-shaped portion 324 further has a flat wall formed with a slit 327 that is parallel to the tube axis and that is aligned with the positioning holes 313 when the slide seat 32 is sleeved on the tube component 31.

The locking unit 33 includes a pivot axle 331, a latch 332, an actuator 333, and an urging member 334.

The pivot axle 331 extends into the seat body 321 of the slide seat 32 in a direction transverse to the tube axis.

The latch 332 is disposed in the seat body 321, is in the form of a thin metal plate in this embodiment, and has one end formed with a positioning tooth 335. The latch 332 is pivotable about the pivot axle 331 between a locking position (see FIG. 5), where the positioning tooth 335 extends through the slit 327 to engage a selected one of the positioning holes 313 in the guide rail 312 so as to lock the slide seat 32 onto the tube component 31, and an unlocking position (see FIG. 6), where the positioning tooth 335 is disengaged from the positioning holes 313 in the guide rail 312 so as to unlock the slide seat 32 from the tube component 31. In this embodiment, the positioning tooth 335 has a tapering shape with a first contact side 337 that abuts against a periphery of the selected positioning hole 313 when the latch 332 is at the locking position, and a second contact side 336 connected to the first contact side 337 and inclined relative to the first contact side 337.

The actuator 333 is connected to the latch 332, and is operable so as to drive movement of the latch 332 from the locking position to the unlocking position. The actuator 333 is made of plastic in this embodiment, and includes a cap-shaped press part 338 and an arm part 339 that extends from the press part 338 and that is connected to the latch 332. The press part 338 is accessible externally of the seat body 321 via the through hole 322.

In this embodiment, the latch 332 is riveted to the arm part 339 of the actuator 333, and the latch 332 and the actuator 333 are pivotally retained on the seat body 321 of the slide seat 32 by the pivot axle 331. In other embodiments of the invention, the latch 332 and the actuator 333 may be integrally formed.

The urging member 334 serves to accumulate a restoring force when the latch 332 is moved from the locking position to the unlocking position. In this embodiment, the urging member 334 is a compression spring that has a first end extending into and abutting against the press part 338 of the actuator 333, and a second end that abuts against the T-shaped portion 324 of the wall part 323 of the seat body 321 of the slide seat 32, as best shown in FIG. 5.

Figure 5:
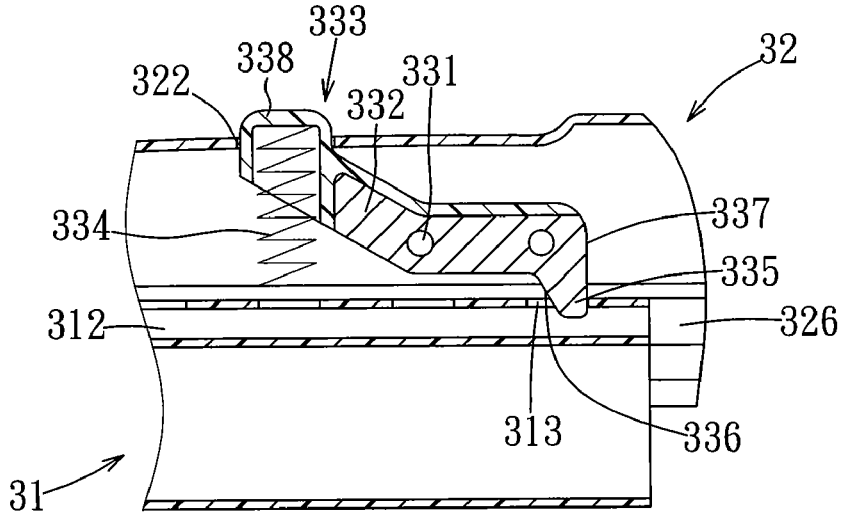
FIG. 5 is a fragmentary sectional view of the first preferred embodiment to illustrate a locking position of a latch of a locking unit.

As shown in FIGS. 1, 4, 5 and 6, by virtue of the spring force of the urging members 334, the press parts 338 of the actuators 333 of the locking units 33 of the seat position-adjusting devices 3 extend out of the through holes 322 in the seat bodies 321 of the slide seats 32, and the positioning tooth 335 of each latch 332 engages one of the positioning holes 313 in the guide rail 312 of the respective tube component 31 such that the latches 332 are disposed at the locking position (see FIG. 5). At the locking position, the first contact side 337 of the positioning tooth 335 of each latch 332 abuts against the periphery of the selected positioning hole 313 so as to lock the slide seats 32 from downward movement relative to the tube components 31.

Figure 6:
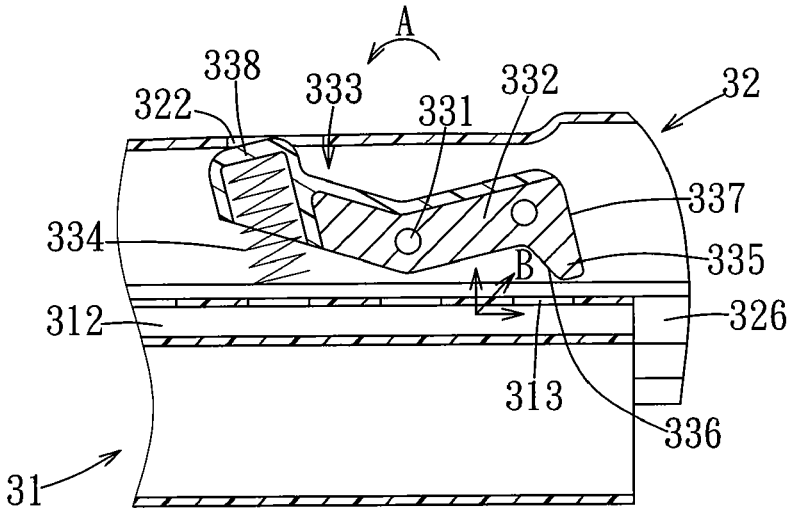
FIG. 6 is a fragmentary sectional view of the first preferred embodiment to illustrate an unlocking position of the latch.
Figure 7:
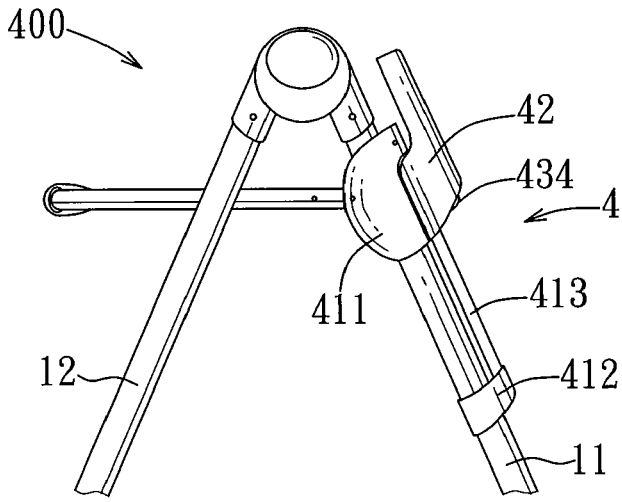
FIG. 7 is a schematic side view of a highchair that incorporates the second preferred embodiment of a seat position-adjusting device according to the present invention, illustrating a seat of the highchair at a highest position.
Figure 8:
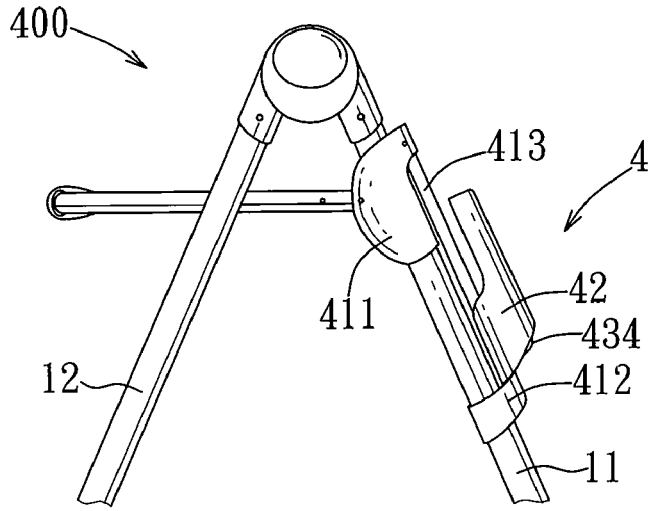
FIG. 8 is a view similar to FIG. 7, but illustrating the seat of the highchair after a downward adjustment operation.
Figure 9:
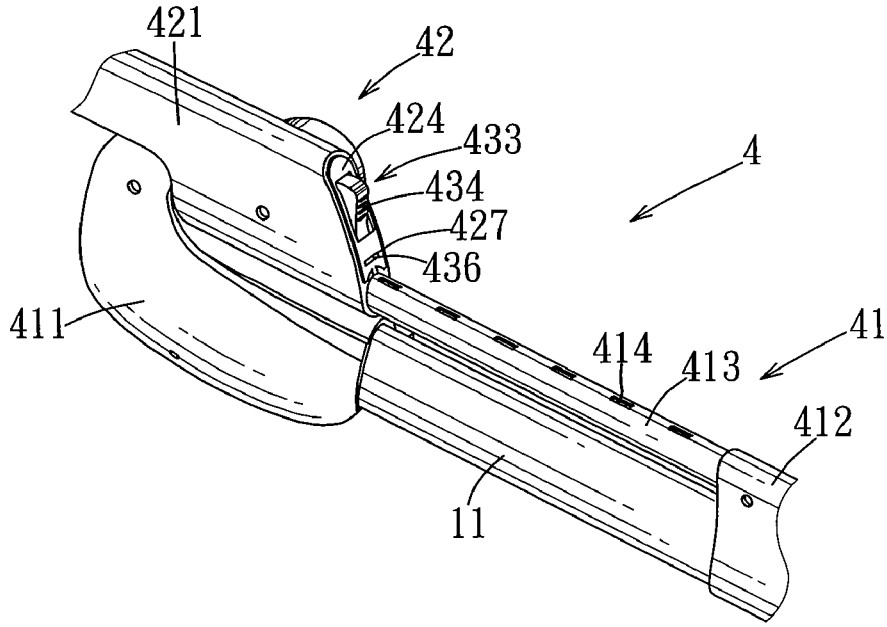
FIG. 9 is an assembled perspective view of the second preferred embodiment.
Figure 10:
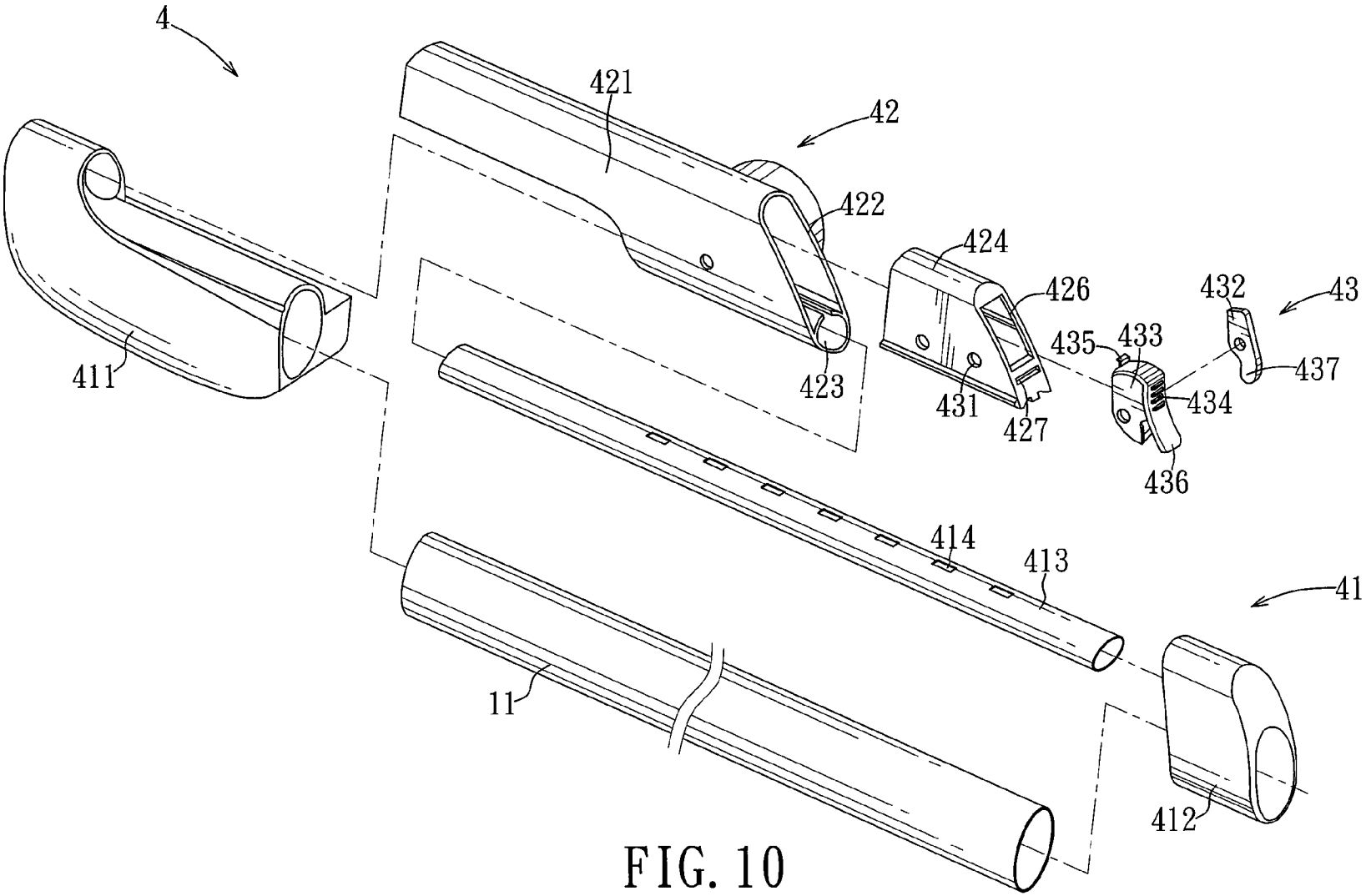
FIG. 10 is an exploded perspective view of the second preferred embodiment.

When the press parts 338 of the actuators 333 of the locking units 33 of the seat position-adjusting devices 3 are pressed, the actuators 333 and the latches 332 pivot about the respective pivot axle 331 in a direction indicated by arrow (A) in FIG. 6 so as to dispose the latches 332 at the unlocking position. At the unlocking position, the positioning tooth 335 of each latch 332 is disengaged from the positioning holes 313 in the guide rail 312 of the respective tube component 31 so as to unlock the slide seats 32 from the tube components 31. At this time, the slide seats 32 may be slid upward or downward along the tube components 31 to adjust the height of the seat 2 relative to the leg unit 1.

After adjusting the seat 2 to the desired height (see FIG. 4), the press parts 338 of the actuators 333 are released, and the urging members 334 restore the latches 332 to the locking position, where the positioning tooth 335 of each latch 332 engages a corresponding one of the positioning holes 313 so as to lock the slide seats 32 at the desired position on the tube components 31. The seat 2 is at a highest position (see FIG. 1) relative to the leg unit 1 when the latches 332 engage uppermost ones of the positioning holes 313 in the tube components 31, and is at a lowest position (see FIG. 4) relative to the leg unit 1 when the latches 332 engage lowermost ones of the positioning holes 313 in the tube components 31.

In this embodiment, when adjusting the seat 2 to a higher position on the leg unit 1, it is only required to pull the seat 2 upward to move the slide seats 32 relative to the tube components 31 without the need to operate the actuators 333. In particular, when the second contact side 336 of the positioning tooth 335 of each latch 332 contacts the periphery of a positioning hole 313, a reaction force indicated by arrow (B) in FIG. 6 will drive the latch 332 to pivot about the corresponding pivot axle 331 in the direction indicated by arrow (A), thereby disengaging the positioning tooth 335 from the positioning hole 313. After upward adjustment of the seat 2 to the desired height, the slide seats 32 are once again locked onto the tube components 31 in the manner described hereinabove by virtue of the locking units 33. Therefore, it is required to operate the actuators 333 only when adjusting the seat 2 to a lower position on the leg unit 1.

FIGS. 7 to 10 illustrate the second preferred embodiment of the seat position-adjusting device 4 according to this invention for a highchair 400. Like the previous embodiment, the seat position-adjusting device 4 includes a tube component 41, a slide seat 42, and a locking unit 43. The locking unit 43 includes a pivot axle 431, a latch 432, an actuator 433, and an urging member 436.

In this embodiment, the tube component 41 includes an upper sleeve part 411 sleeved on one of the front legs 11, a lower sleeve part 412 sleeved on said one of the front legs 11 and spaced apart from the upper sleeve part 411, and a metal tubular rod 413 extending fixedly between the upper and lower sleeve parts 411, 412, disposed adjacent and extending parallel to said one of the front legs 11, and having a front side formed with spaced apart positioning holes 414 that are aligned along a tube axis. The highchair 400 is convertible from an unfolded state, where the tube component 41 is unable to move along said one of the front legs 11, to a folded state, where the front and rear legs 11, 12 are pivoted toward each other and where the upper and lower sleeve parts 411, 412 of the tube component 41 are moved along said one of the front legs 11.

As shown in FIGS. 9 to 12, the slide seat 42 includes a hollow first seat body 421 that is adapted to be connected fixedly to the seat (not visible), that has an open end 422 which faces downwardly, and that is formed with a slide groove 423 to connect slidably with the tubular rod 413. The slide seat 42 further includes a hollow second seat body 424 mounted fixedly in the first seat body 421 for receiving the locking unit 43. The second seat body 424 has an inner wall formed with a limiting block 425. One end of the second seat body 424 adjacent to the open end 422 of the first seat body 421 is configured with a through hole 426 and an insert slot 427.

The pivot axle 431 of the locking unit 43 extends into the second seat body 424. The latch 432 is disposed in the second seat body 424, and is pivotable about the pivot axle 431 between a locking position (see FIG. 11), where a positioning tooth 437 of the latch 432 engages one of the positioning holes 414 in the tubular rod 413 of the tube component 41, and an unlocking position (see FIG. 12), where the positioning tooth 437 of the latch 432 is disengaged from the positioning holes 414 in the tubular rod 413 of the tube component 41. The actuator 433 is connected to the latch 432, and is operable so as to drive movement of the latch 432 from the locking position to the unlocking position. The latch 432 and the actuator 433 are pivotally retained on the second seat body 424 of the slide seat 42 by the pivot axle 431. The actuator 433 has a press part 434 that extends out of the second seat body 424 via the through hole 426. The press part 434 is further formed with a stop 435 for abutting against the limiting block 425 when the latch 432 is at the locking position. The urging member 436 serves to accumulate a restoring force when the latch 432 is moved from the locking position to the unlocking position. In this embodiment, the urging member 436 includes a resilient strip formed integrally with the press part 434 and having a distal end extending into the insert slit 427 and abutting against the second seat body 424. In other embodiments of the invention, the actuator 433 and the latch 432 may be formed integrally.

Figure 11:
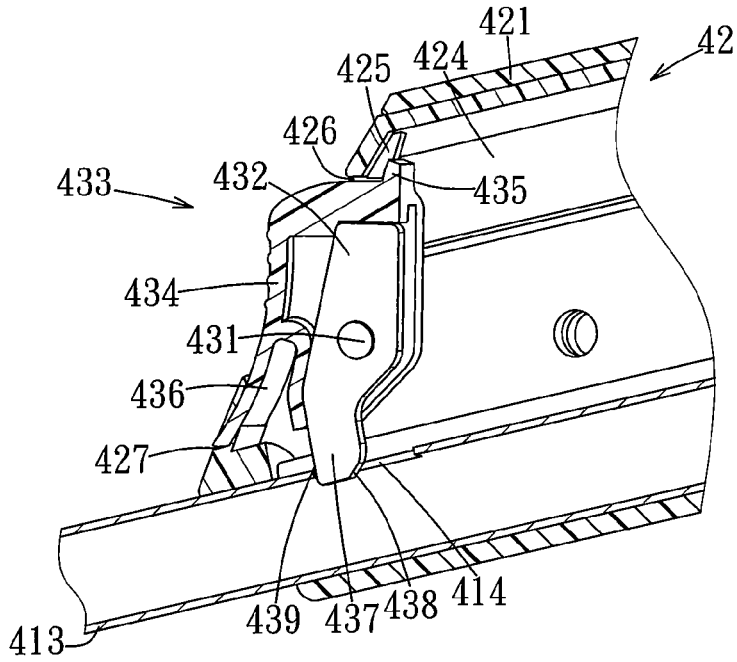
FIG. 11 is a fragmentary sectional view of the second preferred embodiment to illustrate a locking position of a latch of a locking unit.

By virtue of the spring force of the urging member 436, the press part 434 of the actuator 433 is biased to extend out of the through hole 426 in the second seat body 424, and the positioning tooth 437 of the latch 432 engages one of the positioning holes 414 in the tubular rod 413 of the tube component 41 such that the latch 432 is disposed at the locking position (see FIG. 11). At the locking position, a first contact side 439 of the positioning tooth 437 abuts against a lower hole periphery of the selected positioning hole 414 so as to lock the slide seat 42 from downward movement relative to the tube component 41.

Figure 12:
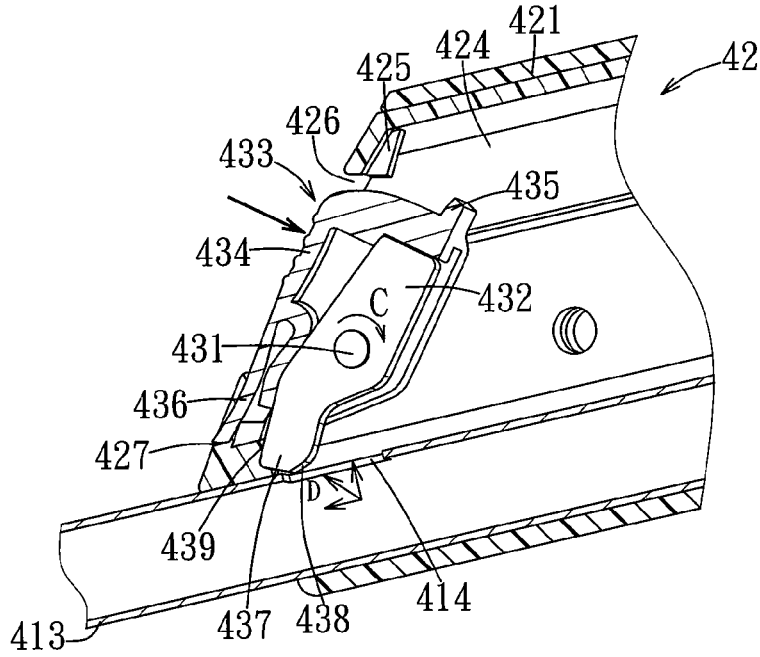
FIG. 12 is a fragmentary sectional view of the second preferred embodiment to illustrate an unlocking position of the latch.
Figure 13:
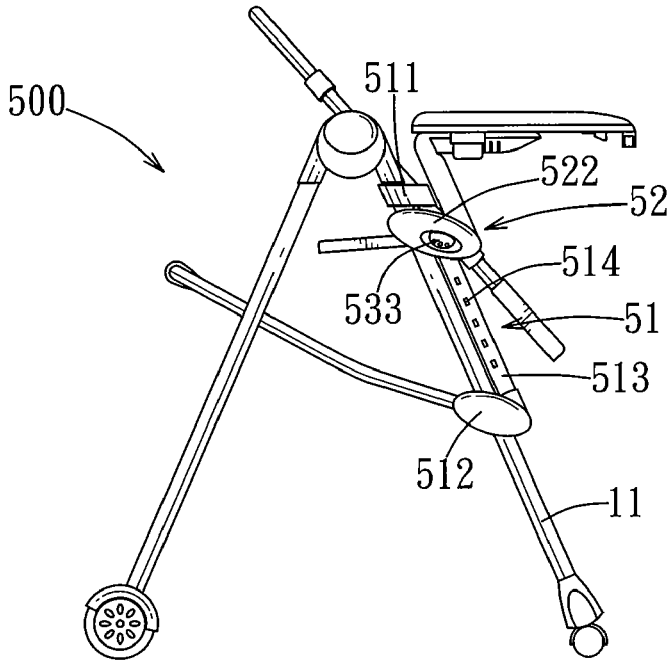
FIG. 13 is a schematic side view of a highchair that incorporates the third preferred embodiment of a seat position-adjusting device according to the present invention, illustrating a seat of the highchair at a highest position.
Figure 14:
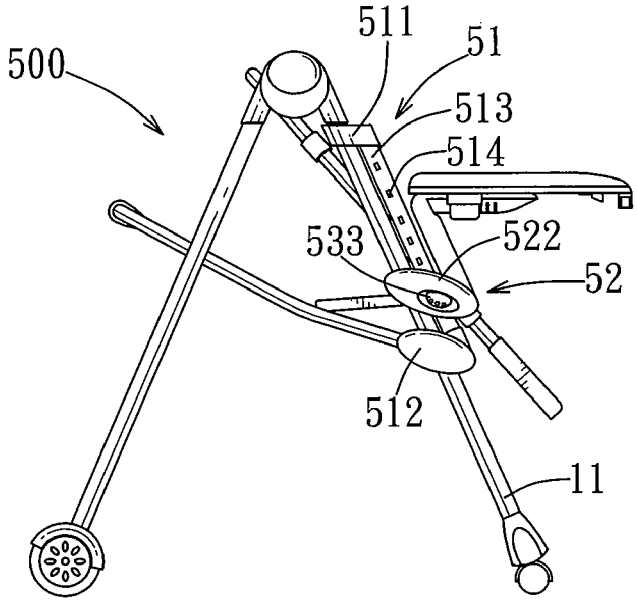
FIG. 14 is a view similar to FIG. 13, but illustrating the seat of the highchair after a downward adjustment operation.
Figure 15:
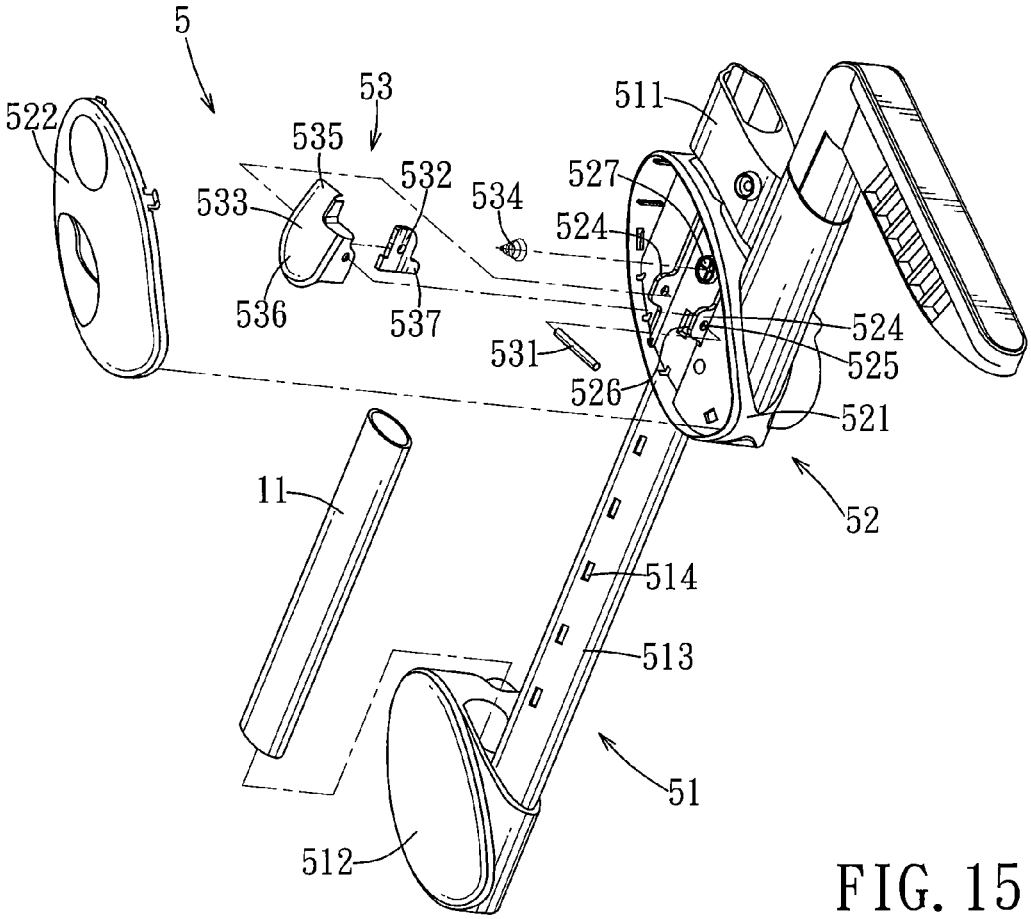
FIG. 15 is an exploded perspective view of the third preferred embodiment.
Figure 16:
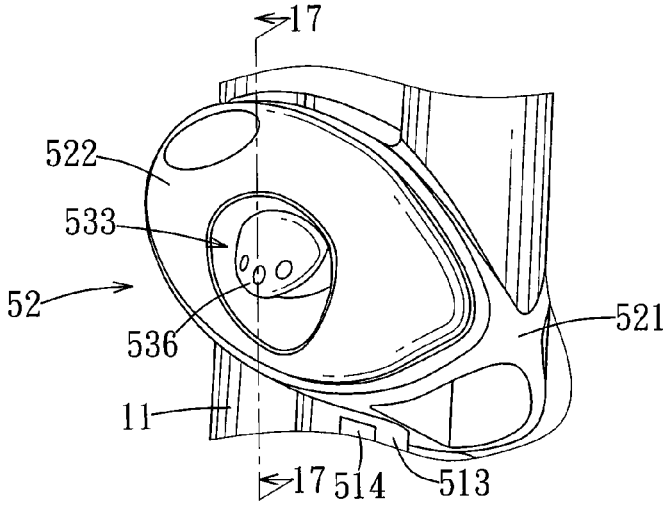
FIG. 16 is a fragmentary assembled perspective view of the third preferred embodiment.

When the press part 434 of the actuator 433 is pressed, the actuator 433 and the latch 432 pivot about the pivot axle 431 in a direction indicated by arrow (C) in FIG. 12 so as to dispose the latch 432 at the unlocking position. At the unlocking position, the positioning tooth 437 of the latch 432 is disengaged from the positioning holes 414 in the tubular rod 413 of the tube component 41 so as to unlock the slide seat 42 from the tube component 41. At this time, the slide seat 42 may be slid upward or downward along the tubular rod 413 of the tube component 41 to adjust the height of the seat (not visible) relative to the front and rear legs 11, 12.

Like the previous embodiment, when adjusting the seat to a higher position, it is only required to pull the seat upward to move the slide seat 42 relative to the tube component 41 without the need to operate the actuator 433. In particular, when a second contact side 438 of the positioning tooth 437 of the latch 432 contacts an upper hole periphery of a positioning hole 414, a reaction force indicated by arrow (D) in FIG. 12 will drive the latch 432 to pivot about the pivot axle 431 in the direction indicated by arrow (C), thereby disengaging the positioning tooth 437 from the positioning hole 414 to permit upward adjustment of the slide seat 42 on the tube component 41.

FIGS. 13 to 16 illustrate the third preferred embodiment of the seat position-adjusting device 5 according to this invention for a highchair 500. The seat position-adjusting device 5 is a modification of the second preferred embodiment, and includes a tube component 51, a slide seat 52, and a locking unit 53. The locking unit 53 includes a pivot axle 531, a latch 532, an actuator 533, and an urging member 534.

In this embodiment, the tube component 51 includes an upper sleeve part 511 sleeved on one of the front legs 11, a lower sleeve part 512 sleeved on said one of the front legs 11 and spaced apart from the upper sleeve part 511, and a tubular rod 513 extending fixedly between the upper and lower sleeve parts 511, 512, disposed adjacent and extending parallel to said one of the front legs 11, and having one side formed with spaced apart positioning holes 514 that are aligned along a tube axis.

As shown in FIGS. 15 to 18, the slide seat 52 includes a hollow seat body 521 sleeved movably on the tubular rod 513 and adapted to be sleeved movably on said one of the front legs 11, and a cover body 522 to close an open side of the seat body 521. The seat body 521 and the cover body 522 cooperate to confine a receiving space 523 (see FIG. 17) for receiving the locking unit 53. Two pivot lugs 524 extend from the seat body 521 into the receiving space 523. Each pivot lug 524 is formed with an axle hole 525. The pivot axle 531 has opposite ends extending through the axle holes 525 in the pivot lugs 524, respectively. The actuator 533 is coupled to the latch 532, and the actuator 533 and the latch 532 are pivotally retained between the pivot lugs 524 of the seat body 521 by the pivot axle 531. The seat body 521 is further formed with an opening 526 to be aligned with a selected one of the positioning holes 514, and a retainer 527 disposed above the opening 526. The urging member 534, which is a compression spring in this embodiment, is positioned in the receiving space 523 by the retainer 527, and abuts against one end 535 of the actuator 533. The other end of the actuator 533 serves as an operating part 536 that extends out of the cover body 522.

Figure 17:
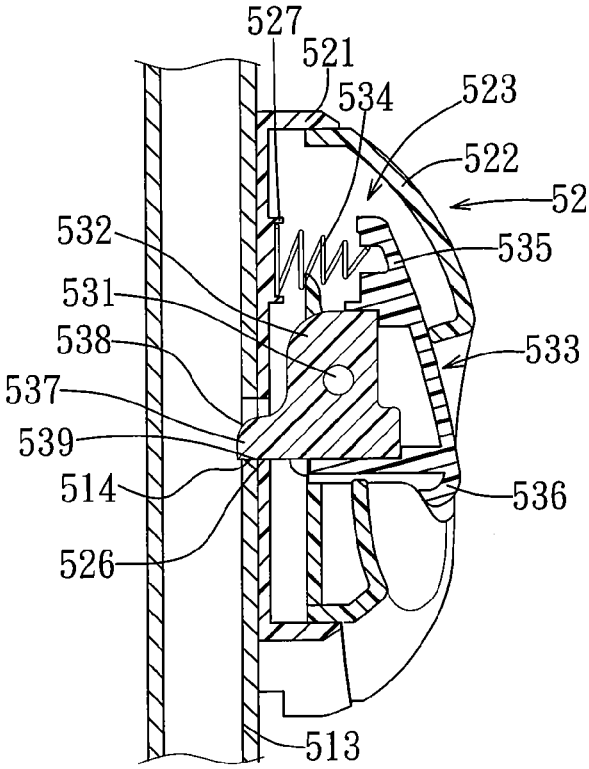
FIG. 17 is a fragmentary sectional view of the third preferred embodiment taken along line 17-17 of FIG. 16, illustrating a locking position of a latch of a locking unit.

By virtue of the spring force of the urging member 534, the positioning tooth 537 of the latch 532 extends through the opening 526 in the seat body 521 and engages one of the positioning holes 514 in the tubular rod 513 such that the latch 532 is disposed at the locking position (see FIG. 17). At the locking position, a first contact side 539 of the positioning tooth 537 abuts against a lower hole periphery of the selected positioning hole 514 so as to lock the slide seat 52 from downward movement relative to the tube component 51.

Figure 18:
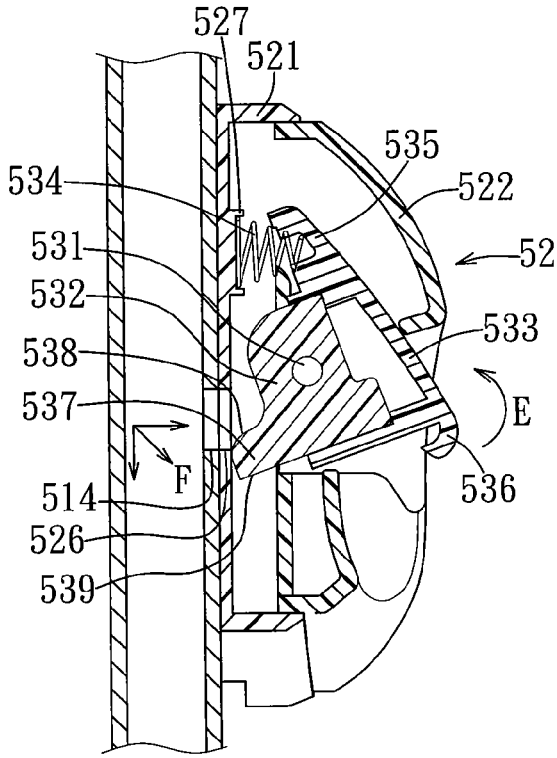
FIG. 18 is a fragmentary sectional view of the third preferred embodiment to illustrate an unlocking position of the latch.

When the operating part 536 of the actuator 533 is operated, the actuator 533 and the latch 532 pivot about the pivot axle 531 in a direction indicated by arrow (E) in FIG. 18 so as to dispose the latch 532 at the unlocking position. At the unlocking position, the positioning tooth 537 of the latch 532 is disengaged from the opening 526 in the seat body 521 and the positioning holes 514 in the tubular rod 513 of the tube component 51 so as to unlock the slide seat 52 from the tube component 51. At this time, the slide seat 52 may be slid upward or downward along the tubular rod 513 of the tube component 51 to adjust the height of the seat of the highchair 500 relative to the front legs 11.

When adjusting the seat to a higher position, it is only required to pull the seat upward to move the slide seat 52 relative to the tube component 51 without the need to operate the actuator 533. In particular, when a second contact side 538 of the positioning tooth 537 of the latch 532 contacts an upper hole periphery of a positioning hole 514, a reaction force indicated by arrow (F) in FIG. 18 will drive the latch 532 to pivot about the pivot axle 531 in the direction indicated by arrow (E), thereby disengaging the positioning tooth 537 from the positioning hole 514 to permit upward movement of the slide seat 52 on the tube component 51.

In sum, locking of the slide seat 32, 42, 52 on the tube component 31, 41, 51 in the seat position-adjusting device 3, 4, 5 of this invention is achieved through engagement of the positioning tooth 335, 437, 537 of the latch 332, 432, 532 with a selected positioning hole 313, 414, 514 of the tube component 31, 41, 51. Unlocking of the slide seat 32, 42, 52 for downward height adjustment is then conducted through mere operation of the actuator 333, 433, 533 for driving pivoting movement of the latch 332, 432, 532. Moreover, through the shape of the positioning tooth 335, 437, 537 of the latch 332, 432, 532, upward height adjustment is possible without the need to operate the actuator 333, 433, 533.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A highchair comprising:

a pair of elongated front legs;

a pair of elongated rear legs connected pivotally and respectively to upper ends of said front legs;

a seat; and a seat position-adjusting device for connecting adjustably said seat to said front legs, said seat position-adjusting device including a tube component sleeved on one of said front legs such that said tube component is axially offset from said one of said front legs, said tube component being formed with a plurality of spaced apart positioning holes aligned along a tube axis, said tube component comprising an upper sleeve part sleeved on said one of said front legs, a lower sleeve part sleeved on said one of said front legs and spaced apart from said upper sleeve part, and a tubular rod extending between said upper and lower sleeve parts, disposed adjacent to said one of said front legs, and formed with said positioning holes, a slide seat sleeved on said tube component and connected to said seat, and a locking unit including a latch disposed in said slide seat, pivoted to said slide seat, and pivotable between a locking position, where said latch engages a selected one of said positioning holes in said tube component to lock said slide seat onto said tube component, and an unlocking position, where said latch is disengaged from said positioning holes in said tube component to unlock said slide seat from said tube component;

wherein said highchair is convertible from an unfolded state to a folded state, in which said front and rear legs are pivoted toward each other.

2. The highchair as claimed in claim 1, wherein said locking unit further includes an actuator connected to said latch and operable so as to drive movement of said latch from the locking position to the unlocking position.

3. The highchair as claimed in claim 1, wherein said locking unit further includes an urging member for accumulating a restoring force when said latch is moved from the locking position to the unlocking position.

4. A highchair comprising:

a leg unit including a pair of elongated front legs, and a pair of elongated rear legs that are connected pivotally and respectively to upper ends of said front legs;

a seat; and a seat position-adjusting device for connecting adjustably said seat to said leg unit, said seat position-adjusting device including a tube component that is sleeved on one of said front legs of said leg unit such that said tube component is axially offset from said one of said front legs, said tube component being formed with a plurality of spaced apart positioning holes aligned along a tube axis, said tube component comprising an upper sleeve part sleeved on said one of said front legs of said leg unit, a lower sleeve part sleeved on said one of said front legs and spaced apart from said upper sleeve part, and a tubular rod extending between said upper and lower sleeve parts, disposed adjacent to said one of said front legs, and formed with said positioning holes;

a slide seat that is sleeved on said tube component and that is connected to said seat, and a locking unit that includes a latch disposed in said slide seat, pivoted to said slide seat, and pivotable between a locking position, where said latch engages a selected one of said positioning holes in said tube component to lock said slide seat onto said tube component, and an unlocking position, where said latch is disengaged from said positioning holes in said tube component to unlock said slide seat from said tube component.

5. The highchair as claimed in claim 4, wherein said latch of said locking unit of said seat position-adjusting device is formed with a positioning tooth for engaging the selected one of said positioning holes in said tube component of said seat position-adjusting device.

6. The highchair as claimed in claim 5, wherein said positioning tooth of said latch of said locking unit of said seat position-adjusting device has a tapering shape with a first contact side that abuts against a periphery of the selected one of said positioning holes in said tube component of said seat position-adjusting device when said latch is at the locking position, and a second contact side connected to said first contact side and inclined relative to said first contact side.

7. The highchair as claimed in claim 4, wherein said locking unit of said seat position-adjusting device further includes an actuator connected to said latch and operable so as to drive movement of said latch from the locking position to the unlocking position.

8. The highchair as claimed in claim 7, wherein said latch and said actuator of said locking unit of said seat position-adjusting device are connected fixedly to each other and are pivotally retained on said slide seat of said seat position-adjusting device.

9. The highchair as claimed in claim 7, wherein said locking unit of said seat position-adjusting device further includes an urging member for accumulating a restoring force when said latch is moved from the locking position to the unlocking position.

10. The highchair as claimed in claim 4, wherein said slide seat of said seat position-adjusting device includes a hollow seat body that is coupled movably to said one of said front legs of said leg unit and that is connected slidably to said tubular rod of said tube component, said latch of said locking unit of said seat position-adjusting device being pivotally retained on said seat body and being extendible through said seat body to engage the selected one of said positioning holes in said tubular rod of said tube component.

* * * * *